United States Patent [19]

Patnaude

[11] 4,164,001

[45] Aug. 7, 1979

[54] SPEED COMPENSATING CONTROL SYSTEM

[76] Inventor: Edmond J. Patnaude, 1240 Lorraine Rd., Apt. 3D, Wheaton, Ill. 60187

[21] Appl. No.: 893,211

[22] Filed: Apr. 4, 1978

[51] Int. Cl.[2] ..... H01H 47/00

[52] U.S. Cl. ..... 361/236; 118/684; 361/240

[58] Field of Search ..... 361/240, 241, 236; 118/11, 2, 8; 324/166, 175

[56] References Cited

U.S. PATENT DOCUMENTS

| | | | |
|---|---|---|---|
| 4,013,037 | 4/1977 | Warning, Sr. et al. | 118/11 X |
| 4,031,466 | 6/1977 | Krause et al. | 324/175 |

*Primary Examiner*—J. D. Miller
*Assistant Examiner*—L. C. Schroeder
*Attorney, Agent, or Firm*—Edmond T. Patnaude

[57] ABSTRACT

There is disclosed a control circuit which provides a control signal for initiating operation of a glue applicator to cause the applicator to apply glue to a predetermined area on an article moving past the applicator, which circuit automatically compensates for variations in the speed of the article.

5 Claims, 3 Drawing Figures

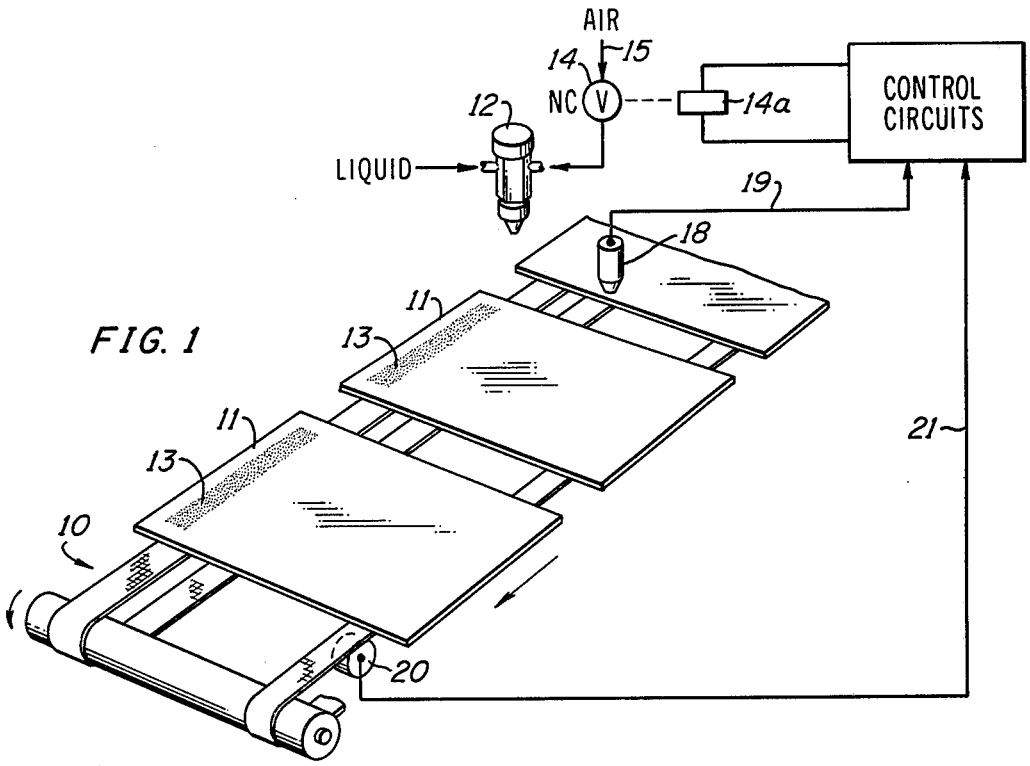
FIG. 1
FIG. 2
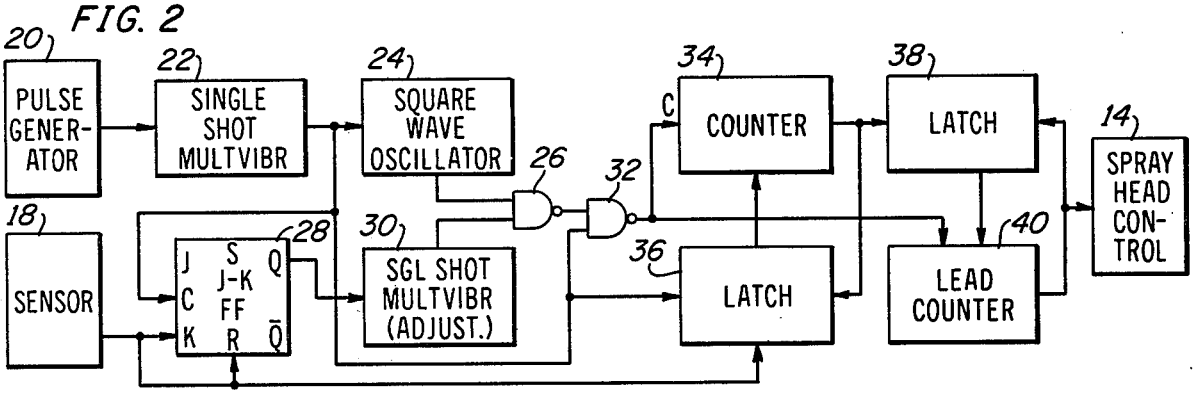
FIG. 3
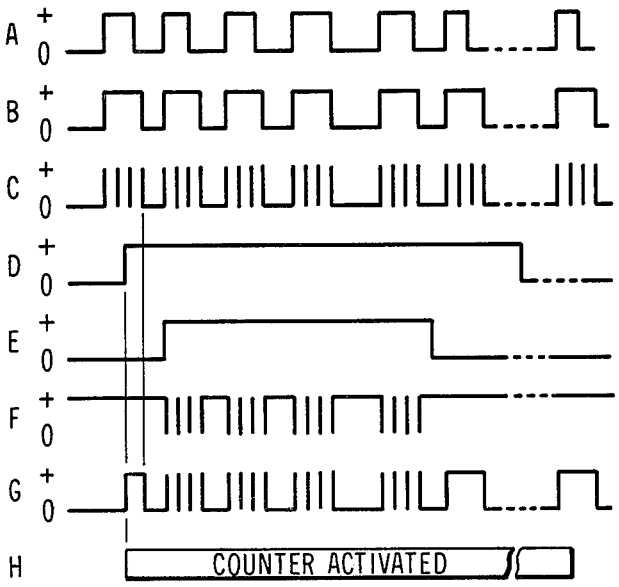

SPEED COMPENSATING CONTROL SYSTEM

The present invention relates in general to control systems for controlling the operation of a device in timed relationship to an article moving past the device at a variable speed, and it relates in particular to a control system which is adapted to be used with a glue applicator for applying glue to predetermined areas of rapidly moving articles.

BACKGROUND OF THE INVENTION

In the manufacture of corrugated boxes, the preslit box board is commonly glued and folded into a flat tubular shape in a folder-gluer machine. In such machines the boards are carried on a conveyor through a gluing station at speeds in the range from a few hundred feet per minute to well over one thousand feet per minute. The glue is applied to the manufacturer's flap or tab, or to the portion of the board to be glued thereto, in a narrow band or stripe by means for example, of a pneumatically operated spray head. Following the gluing operation each board is folded into a flat tubular shape and the glued surface is pressed against the opposing surface. Operation of the spray head or other glue applicator is controlled by means of digital pulses which are generated for each predetermined increment of movement of the conveyor, and these pulses are counted to trigger the controls which cause a valve in the applicator to open and close. These pulses are also used to control the volume of glue which is sprayed from the head to insure a uniform glue density in the pattern irrespective of changes in the conveyor speed.

There is a constant time lag between the occurrence of each trigger pulse which initiates the spray and the time when the glue actually reaches the surface of the board. This time lag includes the time required for the valve in the spray head to operate and the time required for the liquid to travel from the head to the surface of the board. There is another time lag between the occurrence of each trigger pulse which terminates the spray and the time when the application of glue to the board actually stops. Since the amount of board movement during these two fixed time lag periods is related to the conveyor speed, in the prior art glue applicators the longitudinal position of the glue band or stripe has varied when the conveyor speed varied. This variation in glue stripe location presents several problems including, for example, overspray at the front and rear ends of the boxes. Of course, where the system is used for those applications where the pattern must be precisely located, variations in pattern location cannot be tolerated.

SUMMARY OF THE INVENTION

Briefly, there is provided in accordance with the present invention a control system which includes a pulse generator for producing a constant width pulse for each increment of movement of the articles, a sensor for sensing each article when it is at a predetermined location upstream of the applicator, a high frequency oscillator operated in synchronism with the constant width pulses to a counter, and control means for coupling high frequency pulses to the counter only during the occurrence of said constant width pulses and for a brief predetermined period immediately following the sensing of the article. Thereafter, the constant width pulses themselves are coupled to the counter. It may thus be seen that the time required for the counter to count a predetermined number of pulses varies inversely with the velocity of the articles.

The control circuit of the present invention has been successfully used in a gluing system for applying glue in a predetermined pattern to rapidly moving boards in folder-gluer machines of the type commonly used in the corrugated box industry. Consequently, it is described hereinafter in connection with such a system, but it should be understood that the invention has wider application and may be used for controlling many other types of equipment.

GENERAL DESCRIPTION OF THE DRAWING

The present invention will be better understood by a reading of the following detailed description taken in connection with the accompanying drawing wherein:

FIG. 1 is a pictorial illustration, partially schematic, of a gluing system embodying the control circuits of the present invention;

FIG. 2 is a block diagram of the control system of the present invention; and FIG. 3 is a timing chart showing the relationship of a plurality of wave forms appearing at different locations in the control system of the present invention.

DETAILED DESCRIPTION OF THE INVENTION

Referring now to the drawings and particularly to FIG. 1 thereof, a conveyor 10 carries a plurality of boards 11 past a pneumatic spray head 12 which is operated in synchronism with the movement of the boards so as to apply a liquid pattern 13 of precise length and position on each of the boards 11. The liquid emitted from the spray head 12 may be an adhesive material. The operation of the spray head 12 is controlled by means of a normally closed solenoid operated valve 14 connected in a line 15 between the spray head 12 and a source of pressurized air. The spray head 12 may be of the type described in U.S. Pat. No. 3,923,252, and thus sprays liquid only when the valve 14 is open to supply pressurized air thereto. As shown, the valve 14 includes an operating coil or solenoid **14*a* which when energized by a suitable current from the associated control circuits opens the valve 14**.

In order to initiate a control sequence to open and close the spray head 12 at the proper times, a sensor 18 is mounted in proximity to the path of travel of the boards 11 at a location upstream of the spray head 12. The sensor 18 may be a reflective type photo sensor which responds to light reflected from the boards onto a light responsive element therein to provide an electric output signal, and the output of the sensor 18 is coupled to an input of the control circuits by one or more conductors 19. In addition, a pulse generator 20 is mounted adjacent to the conveyor 10 and provides an output signal on one or more conductors 21 connected between the pulse generator 20 and the control circuits. The output from the generator 20 is a train of voltage pulses, each pulse being produced by a predetermined incremental movement of the conveyor. For example, in the system described in connection with FIG. 2 hereof, 10 pulses are generated for each inch of travel of the conveyor. Inasmuch as pulse generators of this general type are well known in the art and the construction thereof forms no part of the present invention, the generator 20 need not be described herein for an understanding of the invention. However, it should be noted that the pulses produced by generators of this type may vary in width from one pulse to the next and, in fact, become shorter in width as the speed of the conveyor 10 increases. Inasmuch as the normal digital control circuits respond to either the positive or negative going transitions of these pulses, the width of the pulses is of no significance in many applications.

In the type of system shown in FIG. 1 the output signal from the sensor 18 intitiates a control sequence which includes the counting of the pulses from the pulse generator to provide a presettable lead distance between the leading edge of each board and the leading edge of the associated pattern and also to provide a pattern of presettable length, the latter being known in the art as the tab. Because of the substantially constant time delays between the energizing and the de-energizing of the solenoid 14*a* and the actual starting and stopping of the liquid spray, it is necessary to incorporate in the control circuits some means for compensating for changes in speed of the conveyor 10 so that the pattern length and location remains constant irrespective of changes in the speed or velocity of the conveyor.

Referring to FIGS. 2 and 3, the pulse generator 20 produces a train of variable width positive going pulses as shown in FIG. 3A and the leading edges of these pulses are used to trigger a single shot multivibrator 22 whose output is, therefore, a train of constant width positive pulses as shown in FIG. 3B. It will be understood by those skilled in the art that the width of the positive output pulses from the multivibrator 22 must be less than the distance between the leading edges of the output pulses from the pulse generator 20 at the maximum conveyor speed with which the associated system operates.

The output pulses from the multivibrator 22 are coupled to a square wave oscillator which is triggered on by the positive going leading edges of the constant width pulses. The oscillator produces square wave pulses at a rate substantially greater than the maximum rate of the pulses from the pulse generator, and in a preferred embodiment of the invention the oscillator 24 generates four positive going pulses during each constant width pulse from the multivibrator 22. The output wave form of the oscillator 24 is shown in FIG. 3C. As shown, this wave from is applied to one input of a NAND gate 26.

Upon sensing a predetermined reference point such as the leading edge of a board, the sensor 18 produces a positive going signal as shown in FIG. 3D, and this signal is applied to the J input of a J-K flip-flop 28 which is operated as a gate. The constant width pulses from the signal-shot multivibrator 22 are coupled to the C input of the flip-flop 28 and the Q output is connected to the trigger input of a single shot multivibrator 30. Therefore, the multivibrator 30 changes state beginning with the leading edge of the next constant width pulse from the multivibrator 22 following the leading edge of the initiating signal. The multivibrator 30 thus provides a positive going output pulse as shown in FIG. 3E whose leading edge is synchronized with both the constant width pulse train and the high frequency bursts from the oscillator 24. The length of the positive going output from the multivibrator 30 is adjustable, but is substantially less than the time required for any given point on a board 11 to move from a position opposite the sensor 18 to a position opposite the spray head 12 at the maximum conveyor speed.

it may be seen from inspection of FIG. 3 that when the output of multivibrator 30 (wave form E) is positive, the output of gate 26 will go negative during each positive excursion of the high frequency pulses (wave form C) from the square wave oscillator 24. When, however, the output of multivibrator 30 is low, the output of the gate 26, which is shown in FIG. 3F, is high. Inspection of FIG. 3 thus shows that the output of the NAND gate 26 is a series of negative going high frequency pulses occurring only during the time that the output from the multivibrator 30 is high.

The output of the NAND gate 26 is connected to one input of a second NAND gate 32. The constant width pulses from the multivibrator 22 are connected to the other input of the NAND gate 32 wherefor the output of the NAND gate 32 toggles at the frequency of the constant width pulses. However, when the output of the NAND gate 26 is toggling at the high frequency rate of the pulses from the oscillator 24, the output of the NAND gate 32 toggles at this high frequency rate during the occurrence of each of the constant width pulses. The output of the NAND gate 32 is shown in FIG. 3G and is connected to the clock input of a counter 34 which responds to both the high and low frequency pulses appearing at the output of the NAND GATE 32. The counter 34 is held in the reset state by a latch 36 which responds to the leading edge of the initiating signal from the sensor 18 to release the counter 34 and thus permit it to begin counting the pulses supplied thereto. As may thus be seen by reference to FIG. 3H the counter is activated when the output signal from the sensor 18 goes positive. When the number set into the counter 34 has been satisfied, the counter 34 is reset and held in the reset state by the latch 36 until a subsequent initiating signal occurs. At this same time the output of the counter 34 operates a latch 38 which releases a lead counter 40 which is supplied with the constant width pulses until such time as the number of pulses thus counted equals the number set into the lead counter at which time it produces an output signal which opens the spray head, resets the counter 40 and through the latch 38 holds the counter 40 in the reset position until the next control sequence occurs. In like manner, when the lead counter 40 operates the spray head it also will operate a tab counter (not shown) which determines the length of the spray pattern by counting a predetermined number of pulses and then closes the spray head. Inasmuch as the present invention is not concerned with the subsequent operation of the control system, that part of the system is not described herein. Suffice to say, however, that the tab counter may operate in the same manner as does the lead counter 40.

It may be seen by inspection of FIG. 3 that inasmuch as the leading edge of the initiating signal as shown in FIG. 3D is a randomly occurring condition, if the counter 34 is activated during the occurrence of a constant width pulse, one pulse will be counted by the counter 34 before the high speed pulses will be counted until such time as the multivibrator changes state and its ouput returns to the low state. However, it will be seen that this fact does not affect the overall accuracy of the system inasmuch as one less low frequency pulse will be counted subsequent to the wave form of FIG. 3E going L0.

OPERATION

In order to understand the need for speed compensation and the manner in which it is effected by the circuit of the present invention, let it be assumed that the sensor 18 is located 6.4 inches upstream of the spray head 12.

Let it be further assumed that the pulse generator 20 produces one positive going pulse for each one-tenth inch of travel of the boards 11 and that the boards 11 are traveling at one thousand feet per minute. If the counter 34 is set to count out upon the reception of 64 pulses and if, for example, it were simply supplied with pulses from the pulse generator, it would count out and energize the lead counter at the exact time the leading edge of the board were passing under the spray head. Thereafter, when the lead counter had counted out to provide an initiate spray pulse, the spray head would be directly opposite the desired location of the leading edge of the pattern. Consequently, the actual pattern would be displaced from the desired location, and such displacement would be proporational to the conveyor speed.

In order to provide the initiate spray pulse at the proper time to cause the pattern to be precisely positioned at the desired location, the improved speed compensation circuit of the present invention causes the lead counter to begin counting the incremental pulses from the pulse generator before the leading edge of each panel passes the spray head, and this lead distance is proportional to the conveyor speed. Since exactly four pulses are supplied to the counter 34 for each incremental pulse from the generator 20 during occurrence of the pulse from the multivibrator 30 (FIG. 3E), and since the number of incremental pulses generated during the occurrence of this pulse is proportional to the conveyor speed, the distance between the leading edge of the panel and the spray head when the counter has counted sixty-four pulses is proportional to the conveyor speed.

The duration of the pulse from the multivibrator 30 (wave form E) is adjustable and may be readily adjusted to the proper value by watching the location of the pattern on the boards while making the adjustment. As the pulse is lengthened the pattern will be moved forward, and when shortened it will move rearward on the boards. Once the duration of this pulse has thus been set to provide the desired pattern location, should the conveyor speed up the number of the high speed pulses coupled to the counter will increase correspondingly to produce the initiate pulse sooner. Similarly if the conveyor slows down, fewer high speed pulses will be applied to the counter 34 wherefor the initiate pulse will be delayed.

The upper limit of the range of compensation provided by this system occurs when the duration of the pulse from the multivibrator 30 equals the time during which 16 incremental pulses are generated. At such a conveyor speed all of the 64 pulses applied to the counter 34 are high speed pulses from the oscillator 24. Therefor, any further increase in the conveyor speed will cause a rearward displacement of the pattern.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modificiations which come within the true spirit and scope of this invention.

What is claimed:

1. A system for providing control signals in response to the movement of articles past a sensor, comprising pulse generating means for producing a train of constant width pulses, each pulse being produced in response to a predetermined incremental movement of said articles, oscillator means for producing a predetermined number of high frequency pulses during each constant width pulse sensor means for sensing each of said articles and for producing an initiating signal in response thereto, counter means for producing a control signal when a predetermined number of pulses have been applied thereto following the occurrence of said initiating signal, and means for coupling said high frequency pulses to said counter means only during the occurrence of said constant width pulses for a predetermined period after the occurrence of said initiating signal and for thereafter coupling said constant width pulses to said counter means, whereby the distance through which said articles move between the time they are sensed and the production of the corresponding control signals is proportional to the velocity of said articles.

2. A system according to claim 1 wherein said means for coupling comprises means for producing a gate signal of predetermined duration following the constant width pulse next occurring after said iniating signal, whereby the number of high speed pulses coupled to said counter is independent of the condition of the output of said pulse generating means when said initiating signal occurs.

3. A system according to claim 2 wherein said means for producing a gate signal comprises a single-shot multivibrator, and means responsive to said initiating signal and said constant width pulses for triggering said multivibrator on the first constant width pulse following said initiating signal.

4. A system according to claim 2 wherein said means for coupling further comprises first gate means for producing an output signal when the polarity of the output of said oscillator bears a predetermined relationship to the polarity of said gate signal, and second gate means for producing an output signal when the polarity of the output signal of said first gate means bears a predetermined relationship to the polarity of the output of said pulse generating means.

5. A system according to claim 1 wherein said oscillator means is enabled only when a signal is applied to the enabling input thereof, and the output of said pulse generating means is coupled to said enabling input, whereby said oscillator is operated in synchronism with said train of constant width pulses.

* * * * *